US005736302A

United States Patent [19]

Buongiorne et al.

[11] Patent Number: 5,736,302

[45] Date of Patent: Apr. 7, 1998

[54] PHOTOGRAPHIC REVERSAL BATH CONCENTRATE AND METHOD OF PREPARING SAME

[75] Inventors: Jean M. Buongiorne, Brockport; Michael J. Haight, Rochester, both of N.Y.

[73] Assignee: Eastman Kodak Company, Rochester, N.Y.

[21] Appl. No.: 820,323

[22] Filed: Mar. 12, 1997

[51] Int. Cl.[6] ..... G03C 7/407

[52] U.S. Cl. ..... 430/379; 430/407

[58] Field of Search ..... 430/379, 407

[56] References Cited

U.S. PATENT DOCUMENTS

| | | | |
|---|---|---|---|
| 3,617,282 | 11/1971 | Bard et al. | 430/379 |
| 4,232,118 | 11/1980 | Okauchi et al. | 430/574 |
| 4,623,612 | 11/1986 | Nishikawa et al. | 430/379 |
| 4,921,779 | 5/1990 | Cullinan et al. | 430/379 |
| 4,975,356 | 12/1990 | Cullinan et al. | 430/393 |
| 5,037,725 | 8/1991 | Cullinan et al. | 430/372 |
| 5,523,195 | 6/1996 | Darmon et al. | 430/393 |
| 5,552,264 | 9/1996 | Cullinan et al. | 430/372 |

*Primary Examiner*—Hoa Van Le
*Attorney, Agent, or Firm*—J. Lanny Tucker

[57] ABSTRACT

A photographic reversal bath concentrate is formulated in such a manner as to avoid precipitates while including new biocides and excluding propionic acid. The concentrate is prepared by adding stannous ion nucleating agent to a solution of an organic phosphonic or phosphinic acid chelating agent, followed by addition of a quaternary ammonium compound as the sole biocide at a concentration of at least about 1 g/l. The quaternary ammonium compound has a molecular weight of from about 175 to about 440.

20 Claims, No Drawings

PHOTOGRAPHIC REVERSAL BATH CONCENTRATE AND METHOD OF PREPARING SAME

RELATED APPLICATION

Copending and commonly assigned U.S. Ser. No. 08/815,771, filed on even date herewith by McGuckin, Badger, Lopez and Schwartz, and entitled "Photographic Reversal Solution and Method of Use".

FIELD OF THE INVENTION

This invention relates to a method of preparing a photographic reversal bath concentrate useful in the processing of color reversal photographic films. This invention also relates to the reversal bath concentrate obtained from this method.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, the materials utilize color forming couplers or dyes in the sensitized layers during processing.

One commercially important process intended for color reversal photographic films useful for providing positive color images, can include the following sequence of processing steps: first (or black-and-white) development, washing, reversal reexposure, color development, bleaching, fixing, washing and/or stabilizing. Another useful process has the same steps, but stabilizing is carried out between color development and bleaching. Such conventional steps are described, for example, in U.S. Pat. No. 4,921,779 (Cullinan et al), U.S. Pat. No. 4,975,356 (Cullinan et al), U.S. Pat. No. 5,037,725 (Cullinan et al), U.S. Pat. No. 5,523,195 (Darmon et al) and U.S. Pat. No. 5,552,264 (Cullinan et al).

Thus, it is known that after the first development, the exposed films are subjected to a reversal reexposure and subsequent color development. Certain nucleating agents have been used in a solution applied after the first development in place of reversal reexposure. Such a solution is known as a "reversal bath". Very early reversal baths contained certain boron compounds as nucleating agents, but they had a number of disadvantages that led to improvements with the use of stannous salts that are stable in both acidic and alkaline environments.

The nucleating agents in the reversal bath are intended to reduce silver ion remaining undeveloped from the first development step. Commercial reversal baths generally contain stannous ion as the silver ion reducing agent, as described for example, in U.S. Pat. No. 3,617,282 (Bard et al). Stannous ion is generally provided in the form of a simple or chelated salt.

Commercial reversal bath solutions, however, can exhibit a number of problems. They may give off an unpleasant odor due to the presence of volatile organic acids (such as propionic acid) typically used as buffers, and undesirable biogrowth may occur in the processing tanks. In addition, reversal bath solutions may require filtration after certain hours of use because of the build-up of organic precipitates from high amounts of biological matter. Reduction of biogrowth is a considerable challenge in the art.

Moreover, there is a growing need to formulate a reversal bath solution in a concentrated form so that the manufacturer and user need not pay for transport or storage of mere water in the solution, and to enable the user to handle and store smaller containers. Moreover, it is desired to have a reversal bath solution that is ready to use after suitable dilution. However, merely concentrating known reversal bath solutions is hardly possible because of the formation of considerable precipitates.

SUMMARY OF THE INVENTION

The noted problems are overcome with a method for preparing a photographic reversal bath concentrate having a final pH of from about 4.5 to about 5.5, and comprising the steps of, in order:

A) forming an aqueous solution of a soluble alkali metal salt of an organic phosphonic or phosphinic acid chelating agent at a concentration of at least about 150 g/l, and B) adding a stannous salt to the aqueous solution to a concentration of at least about 29 g/l, the method further comprising, after step A, adding to the aqueous solution as the sole biocide, a quaternary ammonium compound to a concentration of at least about 1 g/l, the quaternary ammonium compound having a molecular weight of from about 175 to about 440.

This invention also provides a ready-to-use reversal bath concentrate that can be readily diluted for use in photographic processing of color reversal photographic films. This concentrate has a pH of from about 4.5 to about 5.5, and comprises a stannous salt at a concentration of at least about 29 g/l, a quaternary ammonium compound as a sole biocide at a concentration of at least about 1 g/l, and an alkali metal salt of an organic phosphonic or phosphinic acid chelating agent at a concentration of at least about 150 g/l. Heretofore, such components had not been successfully concentrated without the formation of various precipitates.

The reversal bath concentrate so provided is free of volatile organic carboxylic acids such as propionic acid that has an unpleasant odor. Moreover, it has a more effective biocide to inhibit biogrowth in processing tanks. The concentrate can be readily diluted up to 30 times for use in processing without any performance or maintenance problems.

Providing the concentrate of this invention was not an easy task, because the usual methods of formulation (as used to make commercial reversal bath solutions) resulted in considerable precipitates. Precipitates might be tolerable on a small laboratory scale, but in the manufacture of large quantities of concentrated solutions that are stored over long periods of time, precipitates can cause considerable manufacture inefficiencies and performance disadvantages. It's likely also that potential users would reject solutions having considerable precipitates.

It was discovered that taking out the propionic acid from reversal bath formulations, replacing the conventional biocide, and concentrating the remaining components without the formation of precipitates, required a specific order of component mixing, as described herein. This order of mixing was not readily apparent from known teaching in the art, or from our understanding of commercial reversal bath solutions.

DETAILED DESCRIPTION OF THE INVENTION

The ready-to-use reversal bath concentrate of this invention has a final pH of from about 4.5 to about 5.5, preferably from about 5.0 to about 5.5, and most preferably from 5.1 to 5.3. The pH is provided by adding a suitable amount of chemical base, such as a hydroxide at one or more times during the preparation. Preferably, the chemical base is added in several portions in order to accommodate any exotherm generated. Sodiumhydroxide is a preferred chemical base, but others would be readily apparent to a skilled worker in the art.

In the first essential step of this invention, an aqueous solution of one or more suitable organic phosphonic or phosphinic acids (or salts thereof) chelating agents is prepared. The concentration of such chelating agents is generally at least about 150 g/l, and preferably from about 200 to about 250 g/l.

A wide variety of such compounds are known in the art. They are typically organic chelating agents that have numerous utilities in photoprocessing science.

Such chelating agents can be generally represented by the structure I or II:

$$R_1N(CH_2PO_nM_2)_2 \quad (I)$$

or $$R_2R_3C(PO_nM_2)_2 \quad (II)$$

wherein n is 2 or 3, and preferably 3.

$R_1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, o-octamidobenzyl or β-phenethyl), a substituted or unsubstituted alkylaminoalkyl group (wherein the alkyl portion of the group is as defined above, such as methylaminomethyl or ethylaminoethyl), a substituted or unsubstituted alkoxyalkyl group of 1 to 12 carbon atoms (such as methoxymethyl, methoxyethyl, propoxyethyl, benzyloxy, methoxymethylenemethoxymethyl, or t-butoxy), a substituted or unsubstituted cycloalkyl group of 5 to 10 carbon atoms (such as cyclopentyl, cyclohexyl, cyclooctyl or 4-methylcyclohexyl), a substituted or unsubstituted aryl group of 6 to 10 carbon atoms (such as phenyl, xylyl, tolyl, naphthyl, p-methoxyphenyl or 4-hydroxyphenyl), or a substituted or unsubstituted 5- to 10-membered heterocyclic group having one or more nitrogen, oxygen or sulfur atoms in the ring besides carbon atoms [such as pyridyl, pyrimidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R_2$ is hydrogen, a substituted or unsubstituted alkyl group of 1 to 12 carbon atoms (as defined above), a substituted or unsubstituted aryl group of 6 to 10 carbon atoms (as defined above), a substituted or unsubstituted cycloalkyl group of 5 to 10 carbon atoms (as defined above), a substituted or unsubstituted 5- to 10-membered heterocyclic group (as defined above), $—PO_nM_2$ or $—CHR_4PO_nM_2$.

$R_3$ and $R_4$ are independently hydrogen, hydroxyl, a substituted or Unsubstituted alkyl group of 1 to 12 carbon atoms (as defined above) or $—PO_nM_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups herein, useful substituents include, but are not limited to, an alkyl group, hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_nM2$, $—CH_2PO_nM_2$ or $—N(CH_2PO_nM_2)_2$ wherein the alkyl (linear or branched) for any of these groups has 1 to 5 carbon atoms.

Representative phosphonic acids useful in the practice of this invention include, but are not limited to the compounds listed in EP 0 428 101A1 (page 4). Representative useful compounds are aminotris(methylenephosphonic acid), 1-hydroxyethylidene-1,1-diphosphonic acid, diethylenetriaminepentaphosphonic acid, ethylenediamine-N,N,N',N'-tetramethylenephosphonic acid, nitrilo-N,N,N-trimethylenephosphonic acid, 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diamino-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridinylmethylamine-N,N-dimethylenephosphonic acid, 1-hydroxyethane-1,1-diphosphonic acid, diethylenetriamine-N,N,N',N",N"-penta (methylenephosphonic acid), 1-hydroxy-2-phenylethane-1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid, amino tris(methylenephosphonic acid), or salts thereof.

Particularly useful are 1-hydroxyethylidene-1,1-diphosphonic acid, aminotris(methylenephosphonic acid), diethylenetriamine-N,N,N',N",N"-penta (methylenephosphonic acid), or salts thereof. The second compound is most useful.

A chemical base (described above) can be added to the aqueous solution after dissolution of the phosphonic or phosphinic acid. Alternatively, the chemical base can be provided before the phosphonic or phosphinic acid, or simultaneously.

The next essential step in the preparation of the concentrate is to add a source of stannous ions, such as a stannous salt, including stannous chloride, stannous bromide, stannous fluoride and stannous acetate, to the aqueous solution containing the organic phosphonic or phosphinic acid. Preferably, stannous chloride is used. This salt is added to provide to concentration of stannous ions of at least about 29 g/l, and preferably from about 30 to about 40 g/l. Stannous ions are used as nucleating agents in the reversal bath during processing. Sources of stannous ions can be readily purchased from a number of commercial sources.

After step A of our method, a particular quaternary ammonium compound (or mixture thereof) is added to the aqueous solution as the sole biocide in the reversal bath concentrate. This compound is preferably added after step B also, but it can be added prior to addition of the stannous ions, if desired, without the formation of undesirable precipitates. If the surfactant changes the pH of the solution at the time of addition, solution pH may be adjusted appropriately with a chemical base.

Useful quaternary ammonium compounds have one or more quaternary nitrogen atoms in the molecule, and generally have a molecular weight of at least about 175 and less than about 440. Preferably, the molecular weight is from about 250 to about 400, and more preferably it is from about 300 to about 380.

Each quaternary nitrogen atom in the molecule has its four valences filled with nonpolymeric aliphatic, heterocyclic or carbocyclic groups. As used herein, "aliphatic" refers to a monovalent organic radical having 1 to 30 carbon atoms in the backbone that can be interrupted with one or more oxy, thio, imino, or carbonyl groups. Hydrogen atoms along the backbone can be replaced with fluorine atoms to provide fluorinated aliphatic groups. The aliphatic groups can be substituted with one or more halo atoms, aryl, alkoxy, amino, cycloalkyl or other groups as would be readily apparent to one skilled in the art.

As used herein, the term "heterocyclic" refers to a monovalent organic radical having at least one heterocyclic moiety in the backbone containing one or more oxygen, nitrogen or sulfur atoms. In addition, the heterocyclic group can include a quaternary amine group. The heterocyclic group can be aromatic or nonaromatic and generally includes up to 15 atoms in the mono- or polycyclic ring or nucleus which can be substituted with one or more other organic groups if desired as would be readily apparent to one skilled in the art.

The term "carbocyclic" refers to an organic monovalent radical that has all carbon atoms in a mono- or polycyclic ring or nucleus, including cycloalkyl, cycloalkenyl and aryl groups. Such rings generally have up to 14 carbon atoms in the ring structure which can be substituted with one or more other organic groups as would be readily apparent to one skilled in the art.

Useful quaternary ammonium compounds that are biocides for this invention can also be represented by the formula III:

$$R_5(R_6)N^+(R_7)R_8\ X^-$$

wherein $R_5$, $R_6$, $R_7$ and $R_8$ are independently nonpolymeric aliphatic, heterocyclic or carbocyclic radicals as defined above. Preferably, each of the radicals is a monovalent heterocyclic or alkyl group, and the sum of the carbon and hetero atoms in the chains of all four groups is at least 10 and generally less than 20. Most preferably, at least one of the radicals has a chain length of at least 8 carbons, and up to 18 carbons, which can be interrupted with one or more nitrogen or oxygen atoms.

Alternatively, any two or three of the radicals of the noted structure can form a quaternary ring with the nitrogen atom, such as a pyridinium, piperidinium, pyrazinium, quinolinium or morpholino ring.

Particularly useful surfactants in the reversal bath concentrate of this invention are those having quaternary nitrogens with their four valences filled with the same or different hydrocarbon groups having 1 to 20 carbon atoms as long as these are at least 10 carbon atoms for at least one group. Preferably, one or two of the hydrocarbon groups have 1 to 3 carbon atoms, and the remaining hydrocarbon groups are considerably larger, for example having at least 8 carbon atoms. More preferably, one of the groups has at least 12 carbon atoms, and each of the remaining groups has only 1 or 2 carbon atoms.

The anions ($X^-$) for the surfactants can be any suitable negatively charged ion such as a halide that does not form a precipitate in solution or otherwise deleteriously affects the action of the reversal solution. Halides, such as chloride and bromide, are preferred.

Representative surfactants useful in this invention include, but are not limited to, nonyltrimethyl ammonium bromide, dodecyltrimethyl ammonium chloride, hexadecyltrimethyl ammonium bromide (also known as cetyltrimethyl ammonium bromide), hexadecyltrimethyl ammonium chloride (also known as cetyltrimethyl ammonium chloride), benzyltriethyl ammonium chloride, didodecyldimethyl ammonium bromide, benzyldimethylphenyl ammonium chloride, tetrahexyl ammonium chloride, stearyldimethylbenzyl ammonium chloride, cetylpyridinium chloride, benzalkonium chloride (a mixture of alkyldimethylbenzyl ammonium chlorides), myristyltrimethyl ammonium bromide, myristyltrimethyl ammonium chloride, or a mixture of dodecyl, tetradecyl and hexadecyltrimethyl ammonium bromides (also known as "Cetrimide"). A most preferred compound is myristyltrimethyl ammonium bromide. Mixtures of such compounds can be used, if desired.

Many of these compounds are available from a number of commercial sources, including Lonza Chemicals, Zeeland Chemicals Inc. and Spectrum. They may be supplied as pure compounds, aqueous solutions or as aqueous mixtures.

One compound not useful in the present invention is known as Hyamine 1622, benzethonium chloride, or (benzyldimethyl-2-{2-[4-(1,1,3,3-tetramethylbutyl) phenoxy]ethoxy}ethylammonium chloride. Its molecular weight is too high (about 448) and has been observed to result in cloudy solutions and precipitates in working strength reversal bath solutions.

The quaternary ammonium compound useful in the practice of this invention is generally added to a concentration up to at least about 1 g/l, with from about 3 to about 4.5 g/l being preferred. The particular amount of a given compound used in the reversal bath solution will depend upon its solubility and other factors.

The reversal bath concentrate can also include other conventional components such as buffers and sequestering agents, or mixtures thereof. Useful sequestering agents include various known aminocarboxylic acids or aminopolyphosphonic acids or salts thereof. These materials can be added to the aqueous solution at any suitable time that does not promote the formation of precipitates. It is also particularly advantageous that the concentrate does not contain propionic acid.

It may be desirable for the reversal bath concentrate to include one or more stannous ion stabilizers as are known in the art at a suitable time during the method. Preferably, a stabilizer is added sometime after step B, more preferably after step B, and most preferably after the addition of the biocide. Useful stabilizers include, but are not limited to, p-aminophenol, phenylenediamine, Bandrowski's base and Barislowski's Compound. The first compound is preferred. Such stabilizers can be added to a concentration of at least about 0.005 g/l and preferably from about 0.01 to about 2 g/l.

It is also possible that any or all of the steps of the method of this invention are carried out with some agitation. Mixing at the various steps is also generally carried out under ambient temperature and pressure conditions. During some steps of this invention (such as the addition of chemical base), modest heat may be evolved that would require cooling of the solution. It is an advantage that relatively little heat is generated during the method compared to methods utilizing various volatile organic acids.

The concentrate can be supplied in any suitable container made of glass, synthetic polymers, metal or various metal/polymer composites, and any other container that is inert to the components of the solution. A preferred container material is high density polyethylene. The container can be as small as a single-use packet, vial or small bottle, or it can be much larger forms such as drums. Thus, a suitable container can be prepared to hold any suitable volume of concentrate.

The resulting concentrate described herein can be diluted up to 30 times with water or buffer to provide a working strength solution for the processing of color reversal elements. Preferably, the dilution is from about 10 to about 30 times, and a dilution of from 15 to 20 times is most preferred. Alternatively, the concentrate can be diluted as it is being used.

A wide variety of color reversal photographic elements can be processed using the diluted concentrate of this invention. A detailed description of such materials is found, for example, in *Research Disclosure,* publication 38957, pages 592–639 (September 1996). *Research Disclosure* is a publication of Kenneth Mason Publications Ltd., Dudley House, 12 North Street, Emsworth, Hampshire P010 7DQ England (also available from Emsworth Design Inc., 121 West 19th Street, New York, N.Y. 10011).

A wide variety of different color reversal processes are well known in the art. For example, a single color developing step can be used when the coupling agents are incorporated in the photographic element or three separate color developing steps can be used in which coupling agents are included in a developing solution.

The following examples are provided for illustrative purposes only and are not intended to be limiting in any way. Unless otherwise indicated, all percentages are by weight.

Comparative Methods:

A commercially available working strength reversal bath solution has the following components that are mixed in the noted order (in 1 liter):

| | |
|---|---|
| Tap water | 350 g |
| Stannous chloride | 33 g |
| Propionic acid | 238.2 g |
| NaOH (50%) | 123.3 g |
| DEQUEST 2000* (50%) | 250.7 g |
| NaOH (50%) | 123.3 g |
| p-aminophenol | 0.01 g |
| Hyamine 1622** (50%) | 0.2 g |
| NaOH (50%) | 123.3 g |

*DEQUEST 2000 phosphonic acid chelating agent (available from Monsanto contains aminotris (methylenephosphonic acid) chelating agent.
**Hyamine 1622 is benzethonium chloride that is commonly used as a biocide in processing solutions.

This reversal bath solution exhibits significant odor during use from the presence of propionic acid, and biogrowth is often evident in the processing tanks.

In order to eliminate the odor problem, it was thought to leave out the propionic acid. In order to better inhibit the biogrowth, it was thought to replace the Hyamine 1622 with a more effective biocide, such as a quaternary ammonium salt, as described herein.

Control A:

It was attempted to make the following changes with the noted mix order (up to 1 liter):

| | |
|---|---|
| Tap water | 400 g |
| Stannous chloride | 33 g |
| NaOH (50%) | 63 g |
| DEQUEST 2000 (50%) | 125.4 g |
| p-aminophenol | 0.01 g |
| Hexadecyltrimethyl ammonium bromide biocide ("CTAB") | 1 g |
| Tap water | 441.7 g |

After the stannous chloride, anhydrous was added, the resulting solution was cloudy and white in appearance. When NaOH was added, the solution changed from light blue to black in color and black solids (tin oxides) remained at the end of the mixing procedure.

Control B:

Reversing the additions of NaOH and DEQUEST had no effect.

Control C:

Reducing the amount of NaOH also failed to reduce the precipitates.

Control D: Another approach to solving the problem was to prepare the reversal bath concentrate as two parts that were mixed in the following order (to 1 liter):

| | |
|---|---|
| Part A: | |
| Tap water | 200 g |
| NaOH (50%) | 63 g |
| DEQUEST 2000 (50%) | 125.4 g |
| Part B: | |
| Tap water | 600 g |
| Stannous chloride | 33 g |
| Part A | |
| p-aminophenol | 0.01 g |
| "CTAB" | 1 g |

After the addition of Part A, a solid mass of white precipitates formed. "CTAB" is commercially available from Interstate.

EXAMPLE 1

The following reversal bath concentrate of this invention was prepared having the noted components mixed in the following order:

| | |
|---|---|
| Tap water | 800 g |
| NaOH (50%) | 83.5 g |
| DEQUEST 2000 (50%) | 125.4 g |
| Stannous chloride | 33 g |
| p-aminophenol | 0.01 g |
| "CTAB" biocide | 0.5 g |

The resulting concentrate (pH of 5.78) was free of precipitates. When it was diluted 20 times to working strength, it exhibited no precipitates and a only very slight, but acceptable haze.

EXAMPLE 2

The following alternative reversal bath concentrate of this invention was prepared having the noted components that were mixed in the noted order:

| | |
|---|---|
| Tap water | 840 g |
| NaOH (50%) | 77.9 g |
| DEQUEST 2000 (50%) | 125.4 g |
| Stannous chloride | 33 g |
| p-aminophenol | 0.01 g |
| "ATAB" biocide* | 2.5 g |

*"ATAB" is a mixture of dodecyl-, tetradecyl- and hexadecyltrimethyl ammonium bromides that is commercially available from Aldrich Chemical Co (also known as "Cetrimide").

The resulting concentrate was free of precipitates and had an acceptable pH. When it was diluted 20 times to working strength, it was free of precipitates and haze.

EXAMPLE 3

Still another reversal bath concentrate of this invention was prepared having the following components that were mixed in the noted order:

| | |
|---|---|
| Tap water | 840 g |
| NaOH (50%) | 78 g |
| DEQUEST 2000 (50%) | 125.4 g |
| Stannous chloride | 33 g |
| p-aminophenol | 0.01 g |
| "MTAB" biocide* | 3.0 g |

*"MTAB" is myristyltrimethyl ammonium bromide that is commercially available from Zeeland Chemical Inc.

The resulting concentrate had an acceptable pH and was free of precipitates. When it was diluted 20 times to working strength, it was free of precipitates and haze.

In addition, a titration was conducted to determine the correlation between reversal bath concentrate pH and working strength reversal bath pH for the concentrate of this example. The results showed that a concentrate pH within a most preferred range of 5.1 to 5.3 provided a working strength solution pH in the range of from 5.7 to 5.9, which is highly desirable.

EXAMPLE 4

A different mix order was used to prepare the following reversal bath concentrate of the present invention:

| | |
|---|---|
| Tap water | 840 g |
| DEQUEST 2000 (50%) | 125.4 g |
| NaOH (50%) | 78 g |
| "MTAB" biocide | 3 g |
| p-aminophenol | 0.01 g |
| Stannous chloride | 33 g |

The resulting concentrate (pH of 5.3) was free of precipitates even when the stannous ions were added after the biocide.

EXAMPLE 5

A still different mix order was used to prepare the following reversal bath concentrate of the present invention:

| | |
|---|---|
| Tap water | 840 g |
| NaOH (50%) | 78 g |
| DEQUEST 2000 (50%) | 125.4 g |
| p-aminophenol | 0.01 g |
| "MTAB" biocide | 3 g |
| Stannous chloride | 33 g |

The resulting concentrate (pH of 5.3) was free of precipitates even when the additions of NaOH and DEQUEST 2000 chelating agent, and the additions of biocide and stannous ion stabilizer, were reversed. The important feature of this example is that the alkali metal salt of the phosphonic or phosphinic acid chelating agent was added prior to the stannous ions.

EXAMPLE 6

Higher Concentrations

Two concentrates of this invention were prepared that were diluted 25 or 30 times to provide a working strength reversal bath solution. These concentrates had acceptable pH and were prepared with the following components in the noted order to provide the noted dilution levels:

| | 25 times | 30 times |
|---|---|---|
| Tap water | 788 g | 750 g |
| NaOH (50%) | 97.5 g | 117 g |
| DEQUEST 2000 (50%) | 156.7 g | 188.2 g |
| Stannous chloride | 41.2 g | 49.6 g |
| p-aminophenol | 0.0125 g | 0.015 g |
| "MTAB" biocide | 3.75 g | 4.5 g |

No precipitates were observed during mixing for either concentrate. When the concentrates were subjected to a rigorous 2-week crystallization test over 5 temperatures (−17.8 to +21.1° C.), they remained free of precipitates.

EXAMPLE 7

A concentrate of this invention was prepared with a combination of phosphonic acid chelating agents. The method of this invention was compared to a method of mixing outside the invention (Control E). The concentrates were prepared as follows:

| Control E (pH 5.14): | |
|---|---|
| Tap water | 838 g |
| Stannous chloride | 33 g |
| DEQUEST 2000 (50%) | 12.8 g |
| DEQUEST 2006* (40%) | 193.8 g |
| p-aminophenol | 0.01 g |
| "MTAB" biocide | 3 g |

The Control solution exhibited thick white solids after the addition of DEQUEST 2006, which solids went into solution upon agitation. The method of the invention produced no solids or precipitates throughout the mixing procedure.

The invention has been described in detail with particular reference to preferred embodiments thereof, but it will be understood that variations and modifications can be effected within the spirit and scope of the invention.

We claim:

1. A ready-to-use photographic reversal bath concentrate having a pH of from about 5.0 to about 5.5, and comprising:

A) stannous chloride at a concentration of at least about 29 g/l,

B) a quaternary ammonium compound as a sole biocide at a concentration of at least about 1 g/l, and C) an alkali metal salt of an organic phosphonic or phosphinic acid chelating agent at a concentration of at least about 150 g/l, said concentrate being free of propionic acid.

2. The concentrate of claim 1 having stannous chloride at a concentration of from about 30 to about 40 g/l, said quaternary ammonium compound at a concentration of from about 3 to about 4.5 g/l, and said chelating agent at a concentration of from about 200 to about 250 g/l.

3. The concentrate of claim 1 wherein said quaternary ammonium compound is represented by the formula III:

$$R_5(R_6)N^+(R_7)R_8\ X^-$$

wherein $R_5$, $R_6$, $R_7$ and $R_8$ are independently nonpolymeric aliphatic, heterocyclic or carbocyclic radicals, and $X^-$ is a monovalent cation, and said chelating agent is represented by either formula I or II:

$$R_1N(CH_2PO_nM_2)_2 \quad \text{I}$$

$$R_2R_3C(PO_nM_2)_2 \quad \text{II}$$

wherein n is 2 or 3, $R_1$ is hydrogen, alkyl of 1 to 12 carbon atoms, alkylaminoalkyl wherein each alkyl portion has 1 to 12 carbon atoms, alkoxyalkyl of 2 to 12 carbon atoms, cycloalkyl of 5 to 10 carbon atoms in the ring, or a 5- to 10-membered heterocyclic group having one or more nitrogen, oxygen or sulfur atoms in the heterocyclic ring, $R_2$ is hydrogen, alkyl of 1 to 12 carbon atoms, aryl of 6 to 10 carbon atoms in the aromatic ring, cycloalkyl of 5 to 10 carbon atoms in the ring, a 5- to 10-membered heterocyclic group having one or more nitrogen, oxygen or sulfur atoms in the heterocyclic ring, $—PO_nM_2$ or $—CHR_4PO_nM_2$, $R_3$ and $R_4$ are independently hydrogen, hydroxy, alkyl of 1 to 12 carbon atoms, or $–PO_nM_2$, and M is hydrogen.

4. The concentrate of claim 1 further comprising a stannous ion stabilizer.

5. The concentrate of claim 1 having a pH of from about 5.1 to about 5.3, further comprising p-aminophenol as a stannous ion stabilizer, and being free of propionic acid.

6. A method for preparing a photographic reversal bath concentrate having a final pH of from about 4.5 to about 5.5, and comprising the steps of, in order:

A) forming an aqueous solution of a soluble alkali metal salt of an organic phosphonic or phosphinic acid chelating agent present at a concentration of at least about 150 g/l, and B) adding stannous chloride to said aqueous solution to a concentration of at least about 29 g/l, said method further comprising, after step A, adding to said aqueous solution as the sole biocide, a quaternary ammonium compound to a concentration of at least about 1 g/l, said quaternary ammonium compound having a molecular weight of from about 175 to about 440.

7. The method of claim 6 wherein said photographic reversal bath concentrate has a final pH of from about 5.0 to about 5.5.

8. The method of claim 6 wherein said organic phosphonic or phosphinic acid chelating agent is represented by the structure I or II:

$$R_1N(CH_2PO_nM_2)_2 \quad \text{I}$$

$$R_2R_3C(PO_nM_2)_2 \quad \text{II}$$

wherein n is 2 or 3, $R_1$ is hydrogen, alkyl of 1 to 12 carbon atoms, alkylaminoalkyl wherein each alkyl portion has 1 to 12 carbon atoms, alkoxyalkyl of 2 to 12 carbon atoms, cycloalkyl of 5 to 10 carbon atoms in the ring, or a 5- to 10-membered heterocyclic group having one or more nitrogen, oxygen or sulfur atoms in the heterocyclic ring, $R_2$ is hydrogen, alkyl of 1 to 12 carbon atoms, aryl of 6 to 10 carbon atoms in the aromatic ring, cycloalkyl of 5 to 10 carbon atoms in the ring, a 5- to 10-membered heterocyclic group having one or more nitrogen, oxygen or sulfur atoms in the heterocyclic ring, $—PO_nM_2$ or $—CHR_4PO_nM_2$, $R_3$ and $R_4$ are independently hydrogen, hydroxy, alkyl of 1 to 12 carbon atoms, or $—PO_nM_2$, and M is hydrogen.

9. The method of claim 8 wherein said chelating agent is aminotris(methylenephosphonic acid) or an alkali metal salt thereof.

10. The method of claim 6 wherein said chelating agent is added to a concentration of from about 200 to about 250 g/l.

11. The method of claim 6 wherein stannous chloride is added to a concentration of from about 30 to about 40 g/l.

12. The method of claim 6 wherein said biocide is represented by the structure III:

$$R_5(R_6)N^+(R_7)R_8\ X^-$$

wherein $R_5$, $R_6$, $R_7$ and $R_8$ are independently nonpolymeric aliphatic, heterocyclic or carbocyclic radicals, and $X^-$ is a monovalent cation.

13. The method of claim 6 wherein said biocide is added to a concentration of from about 3 to about 4.5 g/l.

14. The method of claim 6 wherein said biocide is nonyltrimethyl ammonium bromide, dodecyltrimethyl ammonium chloride, hexadecyltrimethyl ammonium bromide, hexadecyltrimethyl ammonium chloride, benzyltriethyl ammonium chloride, didodecyldimethyl ammonium bromide, benzyldimethylphenyl ammonium chloride, tetrahexyl ammonium chloride, stearyldimethylbenzyl ammonium chloride, cetylpyridinium chloride, benzalkonium chloride, a mixture of alkyltrimethyl ammonium bromides, and myristyltrimethyl ammonium bromide, or any mixture thereof.

15. The method of claim 6 wherein said biocide is myristyltrimethyl ammonium bromide, hexadecyltrimethyl ammonium bromide, or a mixture of dodecyl- tetradecyl- and hexadecyltrimethyl ammonium bromides.

16. The method of claim 6 wherein a stannous ion stabilizer is added to said aqueous solution after step A.

17. The method of claim 6 wherein said stannous ion stabilizer is p-aminophenol.

18. The method of claim 6 wherein said biocide is added after step B.

19. A photographic reversal bath concentrate prepared by the method of claim 6.

20. A method for preparing a photographic reversal bath concentrate having a final pH of from about 5.0 to about 5.5, comprising the steps, in order:

A) forming an aqueous solution of aminotris (methylenephosphonic acid) chelating agent at a concentration of from about 200 to about 250 g/l, B) adding stannous chloride to said aqueous solution to a concentration of from about 30 to about 40 g/l, C) adding p-aminophenol to said aqueous solution during or after step B, but before step D, and D) adding as the sole biocide, myristyltrimethyl ammonium bromide, hexadecyltrimethyl ammonium bromide, or a mixture of dodecyl- tetradecyl- and hexadecyltrimethyl ammonium bromides to a concentration of from about 3 to about 4.5 g/l.

* * * * *